United States Patent [19]

Bryer et al.

[11] Patent Number: 4,890,555

[45] Date of Patent: Jan. 2, 1990

[54] PRINTING PRESS PLATE LOCKUP

[75] Inventors: Jack Bryer, York; Jan Lindstrom, Landesville; Rex D. Stone, York, all of Pa.

[73] Assignee: Motter Printing Press Co., York, Pa.

[21] Appl. No.: 209,855

[22] Filed: Jun. 22, 1988

Related U.S. Application Data

[63] Continuation-in-part of Ser. No. 57,756, Jun. 3, 1987, abandoned.

[51] Int. Cl.[4] ..... B41F 27/06; B41F 27/12

[52] U.S. Cl. ..... 101/415.1

[58] Field of Search ..... 101/415.1, 378; 51/367, 51/364

[56] References Cited

U.S. PATENT DOCUMENTS

| | | | |
|---|---|---|---|
| 427,320 | 5/1890 | Hawkins | 101/415.1 |
| 2,768,578 | 10/1956 | Park | 101/415.1 |
| 3,095,811 | 7/1963 | Peabody | 101/415.1 |
| 3,359,899 | 12/1967 | Luehrs | 101/415.1 |
| 3,408,933 | 11/1968 | Hermach et al. | 101/415.1 |
| 3,608,487 | 9/1971 | Luehrs | 101/415.1 |
| 3,626,848 | 12/1971 | Tafel | 101/415.1 |
| 3,727,551 | 4/1973 | Kostas et al. | 101/415.1 |
| 3,738,268 | 6/1973 | Swordy et al. | 101/415.1 |
| 3,757,691 | 9/1973 | Etchell et al. | 101/378 |
| 3,913,480 | 10/1975 | Dauner et al. | 101/415.1 |
| 4,347,788 | 9/1982 | Dufour et al. | 101/415.1 |

FOREIGN PATENT DOCUMENTS

| | | | |
|---|---|---|---|
| 0276736 | 1/1988 | European Pat. Off. | 101/415.1 |
| 2048141 | 5/1971 | Fed. Rep. of Germany | 101/415.1 |
| 2547481 | 4/1977 | Fed. Rep. of Germany | 101/415.1 |
| 2755885 | 6/1979 | Fed. Rep. of Germany | 101/415.1 |
| 3626243 | 2/1988 | Fed. Rep. of Germany | 101/415.1 |
| 2092069 | 8/1982 | United Kingdom | 101/415.1 |

*Primary Examiner*—J. Reed Fisher

*Attorney, Agent, or Firm*—Brumbaugh, Graves, Donohue & Raymond

[57] ABSTRACT

A plate lockup for locking a plate on a rotary cylinder of a printing press in which a pair of deflectable springs carried by the rotary cylinder are deflectable by an actuator interposed between them. The actuator deflects one spring to facilitate lockup of a trailing end of a printing plate and then deflects the other spring to clamp a lead end of a printing plate against a lead end register carried by the printing press.

3 Claims, 3 Drawing Sheets

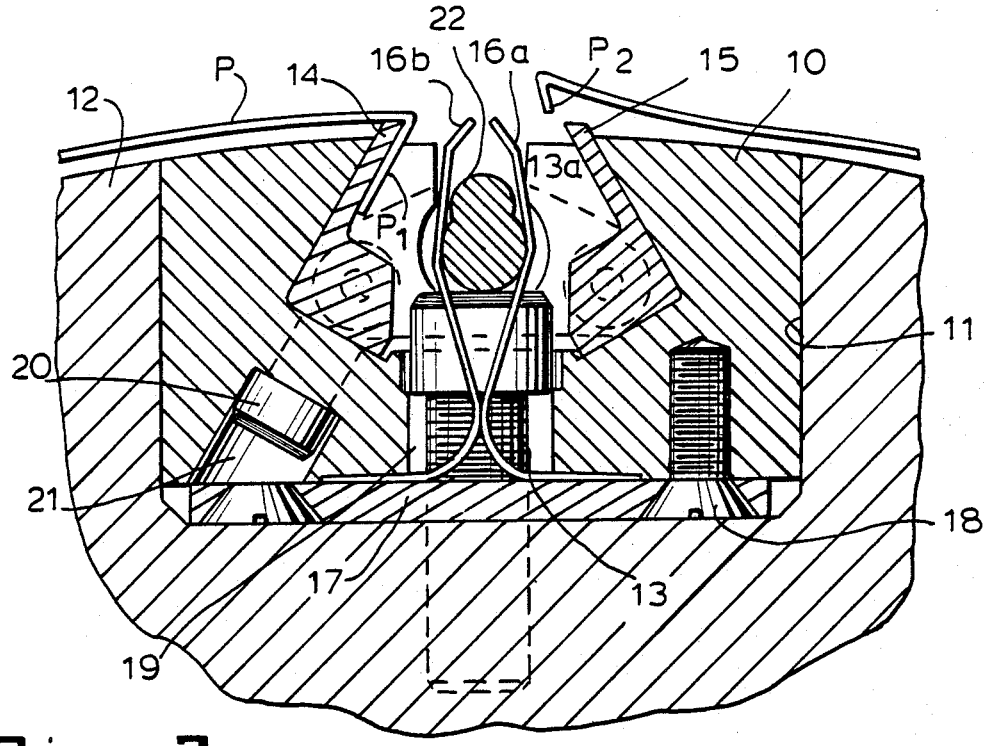
Fig. 2
Fig. 3
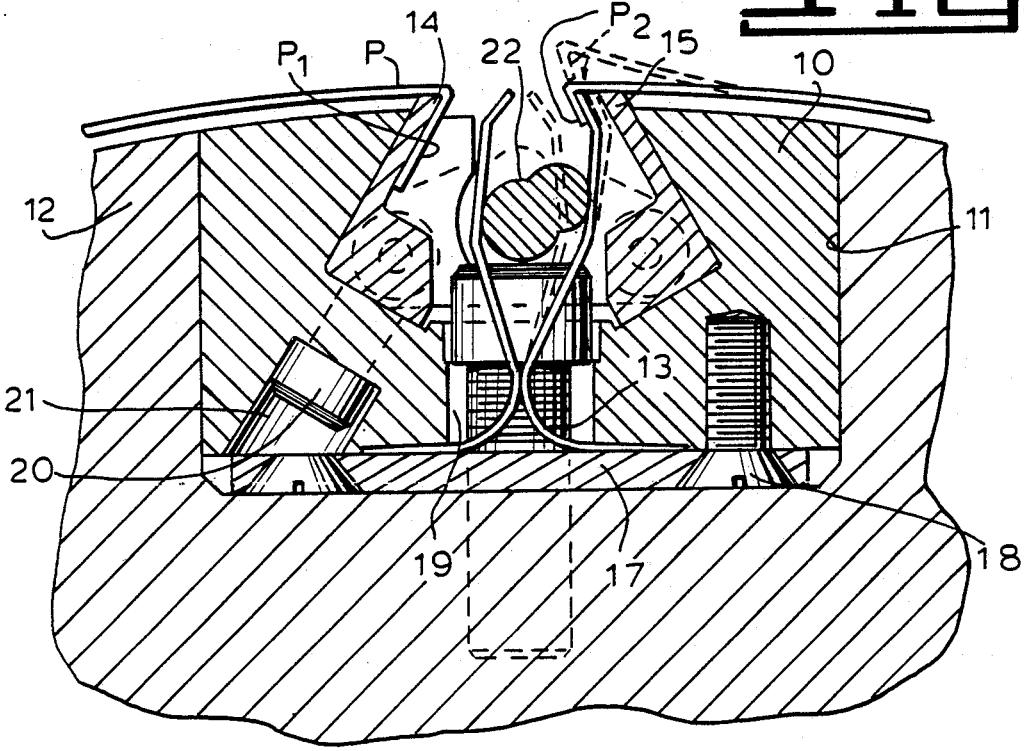

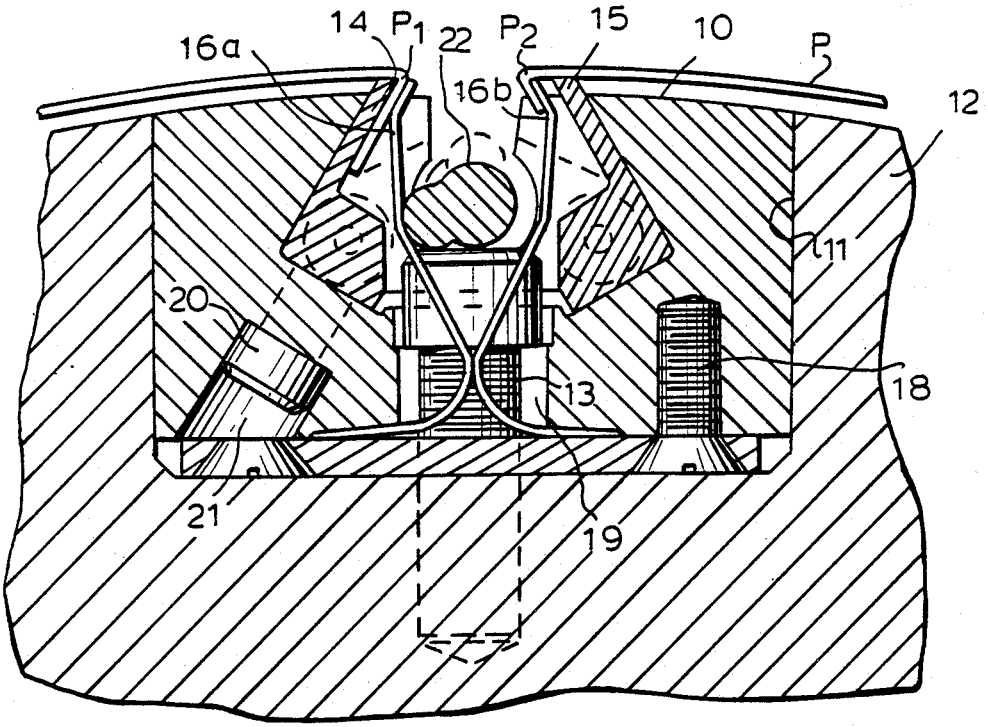
Fig. 4
Fig. 5
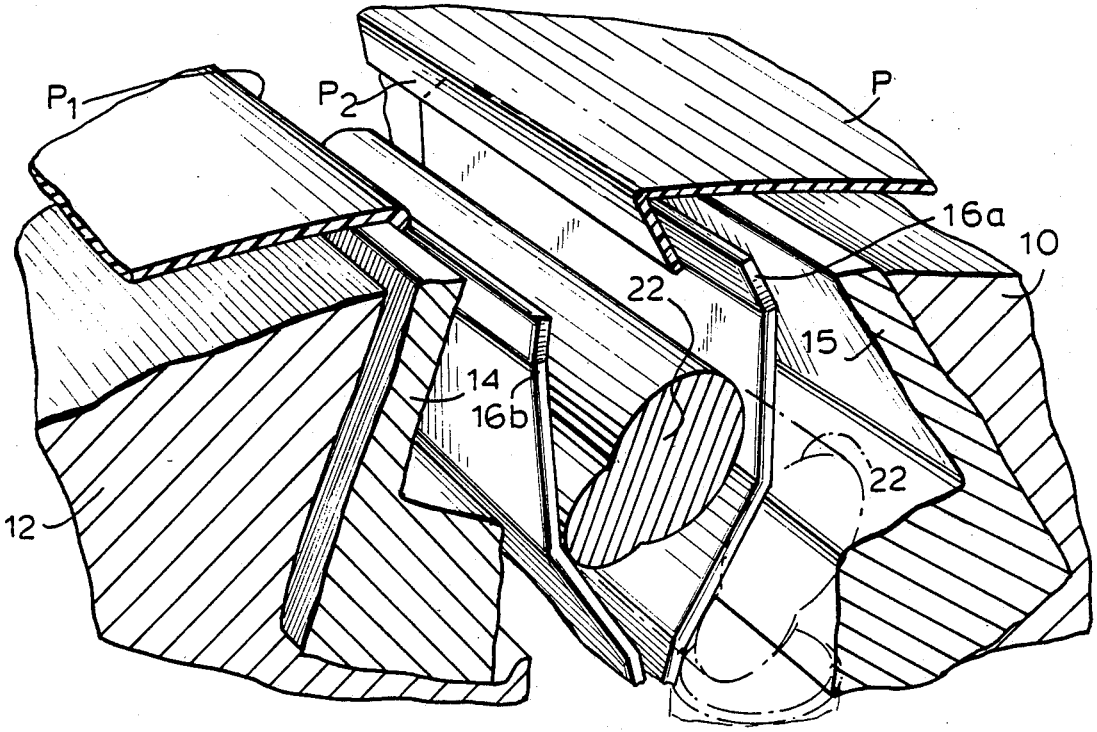

PRINTING PRESS PLATE LOCKUP

This is a continuation-in-part of U.S. patent application Ser. No. 057,756, filed June 3, 1987, now abandoned.

BACKGROUND OF THE INVENTION

This invention relates to a plate lockup for a rotary cylinder of a printing press and, more particularly, to a plate lockup which embodies a lockup register for the leading end of the plate, a pair of deflectable lockup springs carried by the rotary cylinder, one for locking the trailing end of a plate and the other for clamping the leading end of a plate against the lead end register, and actuatable means for deflecting one spring to facilitate lockup of a trailing end of a plate and for deflecting the other spring into positive clamping position against a leading end of the same or a different plate.

The plate lockup of the present invention has been designed specifically for locking a photopolymer printing plate having a metallic or plastic substrate onto a plate cylinder of a flexographic printing press, but it has more general application for the lockup of plates to rotary cylinders of printing presses.

The present invention provides a relatively simple printing press plate lockup in which the leading end of the plate is maintained in proper register on the cylinder by a fixed lead end register and the lockup is achieved by first deflecting the trailing end lockup spring to engage the trailing end of a plate and then releasing it so that it will apply circumferential tension on the plate to pull the lead end of the plate against the lead end register and lock the plate firmly on the cylinder. The other lockup spring is then deflected for positively locking the lead end of the plate against the lead end register.

In a preferred embodiment, the deflections of both springs are controlled by an actuator interposed between the springs. The actuator is operated first to deflect one lockup spring for engagement with the trailing end of the plate and then to deflect the other spring and hold it in locking engagement with the leading end of the plate. The actuator is preferably a rotatable cam interposed between the springs which can be rotated in one direction to effect the trailing end lockup and then in the other direction to effect the lead end clamp. The cam is rotatable to an overcenter position with respect to the lead end clamping spring to maintain the spring in its clamping position until released by the reverse rotation of the cam.

The invention is adapted to provide a symmetrical lockup assembly so that the cylinder can rotate in either direction. The symmetrical lockup assembly includes a retainer for a pair of spaced-apart lead end lockup registers, means for mounting the pair of deflectable springs within the retainer intermediate the lead end lockup registers and means for supporting the common actuating means intermediate the springs. One of the lead end registers serves to lock up and register the lead end of the plate when the cylinder is rotating in one direction and the other lead end register serves to lock up and register the lead end of the plate when the cylinder is rotating in the opposite direction. The deflectable springs are symmetrically arranged so that their functions can be reversed depending on the direction of rotation of the cylinder.

DESCRIPTION OF THE DRAWINGS

For a complete understanding of the invention, reference can be made to the description which follows and to the accompanying drawings in which:

FIG. 2 is a sectional view showing the springs in their undeflected positions;

FIG. 3 is a view similar to FIG. 2 showing one of the springs deflected to lock up the trailing end of a plate;

FIG. 4 is a sectional view similar to FIGS. 2 and 3, showing the other spring deflected to lock the lead end of the plate against the lead end register; and FIG. 5 is a perspective sectional view of the locked position shown in FIG. 4.

DESCRIPTION OF PREFERRED EMBODIMENTS

Figure 1:
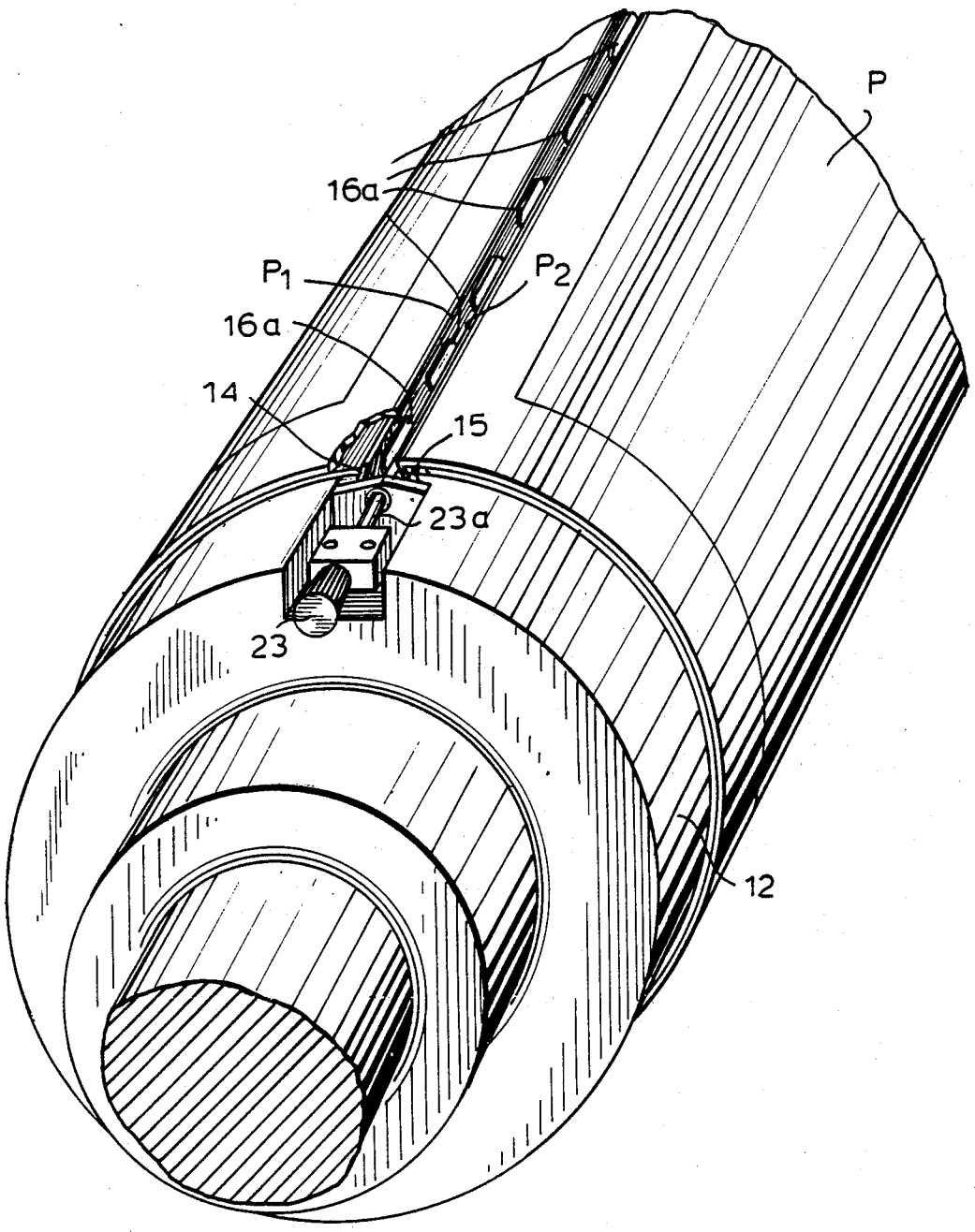
FIG. 1 is a perspective view of one end of a printing cylinder equipped with the plate lockup of the present invention.

The printing press plate lockup of the present invention is shown as a single lockup assembly capable of locking both the lead and trailing ends of a plate to a rotary cylinder. In a typical multicolor press a plurality of lockup assemblies would be provided longitudinally along the cylinder and a plurality would be provided around the circumference of the cylinder. For example, in an eight-plate lockup, four plate lockup assemblies would be arranged longitudinally along the cylinder and two such groups of four would be arranged on the cylinder 180° apart.

Turning now to the plate lockup assembly shown in the drawings, the components thereof are assembled in a retainer 10 inserted into a longitudinal recess 11 in a rotary plate cylinder 12 of the printing press. The retainer is mounted in the recess of the cylinder by a plurality of bolts 13. The retainer 10 extends longitudinally of the cylinder 12 approximately the width of the printing plate P that is to be mounted on the cylinder.

The retainer 10 has a longitudinal chamber which accommodates a pair of spaced-apart lead end registers 14 and 15 and a pair of deflectable springs **16*a* and 16*b* between the lead end registers. The lockup register 14 serves to engage and register the lead end $P_1$ of the plate when the cylinder is rotating in the clockwise direction and the lockup register 15 serves to engage and register the lead end of a plate when the cylinder is rotating in the counterclockwise direction. When the lead end of a plate engages the register 14, the spring 16*a* serves to lock up the trailing end $P_2$. Similarly, when the register 15 serves to engage and register the lead end of a plate, the deflectable spring 16*b*** serves to lock up the trailing end.

The lockup registers 14, 15 are in the form of upstanding fingers which are symmetrically arranged and oppositely oriented to engage the lead end $P_1$ of the printing plate. The lead end of the printing plate is bent downwardly at an acute angle to be engaged by the respective lockup register 14, 15. Although not shown in the drawings, the outer periphery of the rotary cylinder has a plate receiving layer interposed between the outer periphery of the cylinder and the plate.

The lower ends of the lockup springs **16*a* and 16*b* are accommodated in a recess at the base of the retainer 10 and locked in place by a locking plate 17 held by screws 18 to the bottom of the retainer. The springs extend upwardly through a longitudinal slot 19 in the retainer. The upper ends of the springs 16*a* and 16*b*** are bent in opposite directions toward each other to provide alternate lockups, one for engaging the trailing end $P_2$ of the printing plate when the cylinder is rotating in one direction and the other for engaging the trailing end of the plate when the cylinder is rotating in the opposite direction.

The bases of the lockup registers 14, 15 are mounted in the retainer 10 by bolts 20 accommodated in angled holes 21 formed in the bottom of the retainer 10.

Although continuous deflectable lockup springs **16*a* and 16*b* could be embodied intermediate the lockup registers 14, 15, in the preferred lockup assembly shown in FIG. 1, pairs of springs are spaced apart within the retainer. The springs are deflected by a rotatable cam 22 interposed between the pairs of springs. The cam is controlled by a knob 23 at one end of the cylinder connected to the end of the cam by a shaft 23*a***.

The cam 22 and the deflectable springs **16*a*, 16*b* are shown in FIG. 2 their neutral and undeflected positions with a lead end $P_1$ of a plate engaging the register 14 and a trailing end $P_2$ in position to be engaged by the spring 16*a*. The rotation of the cam 22 to the position shown in FIG. 3 deflects the spring 16*a* into position to receive and lockup the trailing end $P_2$ of the printing plate. The rotation of the cam in the opposite direction, as shown in FIG. 4, releases the spring 16*a* so that it will apply circumferential tension on the plate to pull the lead end against the lead end register and lock the plate tightly on the cylinder. The cam then deflects the spring 16*b* into engagement with the lead end $P_1$ of the plate to lock it against the register 14. The upper surface 13*a* of one or more of the bolts 13** provides a stop to limit the rotation of the cam. Alternatively, a separate adjustable stop can be provided.

In moving to the position shown in FIG. 4, the raised portion of the cam passes through an on-center position of maximum deflection with respect to the spring **16*b*** to an over-center position determined by the stop. The force of the spring maintains the cam in the over-center position determined by the stop until it is desired to release the cam.

Although the drawings show a single control knob 23 for controlling the deflection of a plurality of springs for locking a single printing plate, if two or more plates are to be locked side-by-side, the spring deflecting cams associated with the plates can be separately controlled by control knobs arranged in tandem and connected with their respective cams by coaxial shafts.

The plate lockup of the present invention makes it possible to lockup and remove the plates quickly and easily while insuring that the leading ends of the plates are in proper register on the rotary cylinder. The lockup assembly is easily installed and removed for servicing.

The invention has been shown in a single, preferred form and by way of example only, and many modifications and variations can be made therein within the spirit of the invention. The invention, therefore, is not intended to be limited to any particular form or embodiment, except insofar as such limitations are expressly set forth in the claims.

We claim:

1. A plate lockup for locking a plate on a rotary cylinder of a printing press, comprising a pair of registers carried by the rotary cylinder for registering the leading end of a plate, the register used depending on the direction of rotation of the cylinder, a pair of deflectable, symmetrical springs carried by the rotary cylinder, the springs having outwardly extending, resilient ends, one for locking the trailing end of a plate and the other cooperating with a register for locking the leading end of the plate against the register, a rotatable cam interposed between the springs, said cam having a raised portion rotatable in one direction into engagement with one spring and in the other direction into engagement with the other spring to deflect the springs toward different registers, the raised portion of the cam being rotatable past an on-center position to an over-center position with respect to each spring, and a stop for limiting the rotation of the cam in the over-center position, in which position the cam locks the spring in clamping position with the register and the spring locks the cam in the over-center position determined by the stop.

2. A plate lockup as set forth in claim 1 including a retainer mounted in a recess of the rotary cylinder and accomodating said plate registers, said pair of springs, the rotatable cam and said stop.

3. A plate lockup as set forth in claim 1 including a control knob at one end of the cylinder for imparting rotation to the cam and a control shaft connecting the control knob with the end of the cam.

* * * * *